US008627639B2

(12) United States Patent
Ali et al.

(10) Patent No.: US 8,627,639 B2
(45) Date of Patent: Jan. 14, 2014

(54) METHOD AND SYSTEM FOR DETERMINING AN ORDER OF FILL FOR A PLURALITY OF PILLS IN A MULTI-DOSE MEDICAMENT CONTAINER

(75) Inventors: Syed Y. Ali, Chicago, IL (US); Amy C. Biesenthal, Buffalo Grove, IL (US); Rishi Khullar, Deerfield, IL (US); Victor Lee, Lake Forest, IL (US); Sean McGonagle, Buffalo Grove, IL (US); Greg Pankow, Morton Grove, IL (US)

(73) Assignee: Walgreen Co., Deerfield, IL (US)

( * ) Notice: Subject to any disclaimer, the term of this patent is extended or adjusted under 35 U.S.C. 154(b) by 624 days.

(21) Appl. No.: 12/234,221

(22) Filed: Sep. 19, 2008

(65) Prior Publication Data

US 2010/0071320 A1 Mar. 25, 2010

(51) Int. Cl.
*B65B 1/04* (2006.01)

(52) U.S. Cl.
USPC ..... 53/473; 53/474

(58) Field of Classification Search
USPC ..... 53/473, 474, 475, 443, 154, 237; 356/301, 328, 326
See application file for complete search history.

(56) References Cited

U.S. PATENT DOCUMENTS

| | | | | |
|---|---|---|---|---|
| 3,780,856 | A * | 12/1973 | Braverman | 206/534 |
| 4,554,955 | A * | 11/1985 | von Lersner et al. | 141/1 |
| 4,583,345 | A * | 4/1986 | Hirosaki et al. | 53/77 |
| 4,655,026 | A | 4/1987 | Wigoda | |
| 4,817,819 | A * | 4/1989 | Kelly | 221/2 |
| 4,998,623 | A | 3/1991 | Doull | |
| 5,450,710 | A | 9/1995 | Jensen et al. | |
| 6,023,916 | A * | 2/2000 | Bouthiette | 53/471 |
| 6,535,637 | B1 * | 3/2003 | Wootton et al. | 382/190 |
| 6,769,228 | B1 | 8/2004 | Mahar | |
| 6,805,259 | B2 | 10/2004 | Stevens et al. | |
| 7,100,793 | B2 | 9/2006 | Baum | |

(Continued)

FOREIGN PATENT DOCUMENTS

| | | |
|---|---|---|
| DE | 10 2006 007 136 A1 | 12/2006 |
| EP | 1 985 544 A1 | 10/2008 |
| EP | 2 112 078 A1 | 10/2009 |

OTHER PUBLICATIONS

"What is Medicine on Time," Medicine-On-Time University, 2008, 1 page.

(Continued)

*Primary Examiner* — Sameh H. Tawfik
(74) *Attorney, Agent, or Firm* — Francis C. Kowlik; Randall G. Rueth; Gerstein & Borun LLP

(57) ABSTRACT

A method in a computer system of distributing pills into containers for use by a patient includes obtaining from a memory a fill pattern including a mapping of each of a first plurality of pills to one of a first plurality of containers such that at least two of the first plurality of pills are mapped to the same one of the first plurality of containers, obtaining from the memory an attribute of each of the first plurality of pills such that at least two of the first plurality of pills differ in at least the obtained attribute, and automatically sorting the first plurality of pills according to the attribute of each of the plurality of pills according to a predefined order to generate an ordered list corresponding to an order of depositing the first plurality of pills into the first plurality of containers.

15 Claims, 6 Drawing Sheets

(56) References Cited

U.S. PATENT DOCUMENTS

| | | | | |
|---|---|---|---|---|
| 7,185,476 | B1 | 3/2007 | Siegel et al. | |
| 7,218,395 | B2 * | 5/2007 | Kaye et al. | 356/301 |
| 7,712,288 | B2 | 5/2010 | Ramasubramanian et al. | |
| 7,971,414 | B1 | 7/2011 | McGonagle et al. | |
| 2003/0216974 | A1 | 11/2003 | Browne | |
| 2004/0148054 | A1 | 7/2004 | Schwartz | |
| 2005/0004700 | A1 | 1/2005 | DiMaggio | |
| 2005/0033606 | A1 | 2/2005 | Miller | |
| 2005/0065645 | A1 | 3/2005 | Liff et al. | |
| 2005/0109658 | A1 | 5/2005 | Bindford | |
| 2005/0218152 | A1 | 10/2005 | Simon | |
| 2006/0074521 | A1 | 4/2006 | Rice et al. | |
| 2006/0149587 | A1 | 7/2006 | Hill et al. | |
| 2006/0161294 | A1 | 7/2006 | DiMaggio | |
| 2006/0161298 | A1 | 7/2006 | DiMaggio | |
| 2007/0067250 | A1 | 3/2007 | Mahar | |
| 2007/0095850 | A1 | 5/2007 | Meyer | |
| 2007/0185615 | A1 | 8/2007 | Bossi et al. | |
| 2007/0250346 | A1 * | 10/2007 | Luciano et al. | 705/2 |
| 2008/0071421 | A1 | 3/2008 | Silverbrook et al. | |
| 2008/0097787 | A1 | 4/2008 | Palazzolo et al. | |
| 2008/0190076 | A1 | 8/2008 | Klingel et al. | |
| 2009/0030725 | A1 * | 1/2009 | Nadas et al. | 705/3 |
| 2010/0031611 | A1 | 2/2010 | Ali et al. | |

OTHER PUBLICATIONS

"Product Line," Medicine-On-Time University, 2008, 5 pages.

U.S. Appl. No. 12/102,570, filed Apr. 14, 2008.

International Search Report and Written Opinion for Application No. PCT/US09/033050 dated Apr. 15, 2009.

International Search Report and Written Opinion for Application No. PCT/US09/033050 dated Mar. 22, 2011.

Office action for U.S. Appl. No. 12/102,570 issued Jan. 24, 2011.

Final Office action for U.S. Appl. No. 12/102,570 issued Jul. 25, 2011.

Office action or U.S. Appl. No. 12/187,218 issued Aug. 11, 2011.

* cited by examiner

METHOD AND SYSTEM FOR DETERMINING AN ORDER OF FILL FOR A PLURALITY OF PILLS IN A MULTI-DOSE MEDICAMENT CONTAINER

FIELD AND BACKGROUND OF THE DISCLOSURE

1. Field of the Disclosure

This disclosure relates generally to methods and systems for filling medication containers and, in particular, to a method of determining an order of filling a multi-dose medicament container for a plurality of prescriptions, nutraceuticals, vitamins, over-the-counter medications, etc.

2. Background Description

Traditional methods of packaging, for example, prescription medicaments include dispensing an entire single prescription's worth of pills into a single medicament container affixed with a label displaying (among other data) patient identification, pill identification, dosage, and ingestion instructions. If a patient needs to take multiple medications, a single, filled medicament container is typically issued for each prescription. Furthermore, if a patient is required to take the multiple medications at different times of the day and/or night, the patient must have all of the single, filled medicament containers readily available, and the patient must remember when, which and how many pills he or she needs to take. Thus, traditional methods of packaging multiple prescription medicaments result in inconvenience to the patient as entire sets of single, filled medicament containers must be brought along. Other undesirable effects of traditional packaging methods include difficulty for the patient in remembering the time, the type, and the number of pills to take. These types of problems may lead to a patient failing to take a medicine at the appropriate time or taking too much medicine within a short period of time, which may cause adverse affects to the patient's health.

Recent advances in prescription packaging have attempted to mitigate these problems. For instance, a multi-dose blister pack may be used to fill a plurality of prescriptions for a patient. Examples of multi-dose blister packs may be found in U.S. Provisional Patent Application Ser. No. 60/947,169 entitled "Nested Multi-Dose Blister Pack," the entire disclosure of which is incorporated by reference. A machine and process for filling multi-dose blister packs may be found in U.S. Provisional Patent Application Ser. No. 60/940,790 entitled "Multi-Dose Filling Machine and Process," the entire disclosure of which is also incorporated by reference.

Multi-dose blister packs may contain a plurality of individual blister cells, each of which may hold one or more pills of different medications prescribed for a patient. One multi-dose blister pack, for instance, may include a label "morning," so that each individual blister cell on the "morning" pack may contain the complete set of pills from a patient's multiple prescriptions that are to be ingested in the morning. Of course, the multi-dose blister pack may also include other labels related to information other than the dosage regime. The patient may also receive additional filled, multi-dose blister packs that have individual blister cells, some or each containing the correct multiple medications to be ingested at "noon" and "night." Alternatively, blister packs may be filled to a different level of granularity. For example, a single multi-dose blister pack may have rows labeled "morning," "noon," and "night" and have columns labeled with the day of the week. So, on Tuesday night, the patient would ingest the correct set of pills from his or her multiple prescriptions by taking the pills from the individual blister cell located at the intersection of the "night" row and the "Tuesday" column. Other fill patterns of multi-blister packs are also possible.

Multi-dose blister packs may be perforated into individual, easily-portable blister cells. In some embodiments, the blister cells on a single multi-dose blister pack may be similarly sized. Alternatively, some of the blister cells on a certain blister pack may be sized differently to accommodate a different number or volume of pills, for example. Each blister cell may be labeled on the back with the different medications contained within the blister cell, and may also list patient information, time/day/date information for ingestion, and the like. A patient may separate out from the pack the specific blister cells that he or she will need during a specific time period, and thus does not need to carry multiple large single filled medicament containers for each of his/her multiple prescriptions. The patient is not required to sort out the dosages of multiple medications for a particular dosage regime. Additionally, the labeling on the blister packs may aid the patient in keeping track of whether medications have been taken.

Another example of an advance in prescription packaging is an individual medicament pouch or packet. Examples of individual medicament pouch/packets may be found in U.S. patent application Ser. No. 11/741,539 entitled "Serially Connected Packets with Grasping Portion" and in U.S. patent application Ser. No. 11/741,542 entitled "Serially Connected Packets with End Indicator." The total combination of medications that are prescribed to be ingested at a same time may be filled into an individual medicament pouch or packet. A label may be affixed or printed directly onto the pouch that displays the time/day/date for ingestion, patient information, and medicaments contained inside the pouch. Thus, a patient need only port along the pouches that s/he will need during a specific time period. The patient need not determine what combination of pills needs to be taken at various times, as the individual filled pouches provide the groupings. The time/day/date label assists the patient in remembering whether or not the medicaments have been ingested or not.

Thus, a "multi-dose medicament container," as used herein, is a receptacle that holds a set of medications, over-the-counter pills, vitamins, or nutraceuticals corresponding to multiple prescriptions or non-prescription dosages of a patient, usually (but not necessarily) on a per-ingestion time basis. A multi-dose medicament container may have a single receptacle, such as a traditional prescription container or a pouch. A multi-dose medicament container may have multiple receptacles, such as a blister pack. Other types of multi-dose medicament containers may be possible. A "dosage regime," as used herein, may refer to time of ingestion for example and is a general time reference for ingestion of the medication rather than an exact time on a clock. For instance, a dosage regime may be with an evening meal, before or after a meal, every other day, and the like. Further, the dosage regime may specify or restrict ingestion according to prescription directions or medication directions (e.g., for nutraceuticals and OTCs).

Filling the multi-dose blister packs, pouches, and other multi-dose medicament container configurations may be done manually or automatically. A "fill pattern," as used herein, is defined as a mapping of pills from one or more prescriptions of a patient into one or more receptacles of one or more multi-dose medicament containers. Fill patterns may be complex. For example, in the case of a blister pack, if Prescription A is required to be ingested once a day, and Prescription B is required to be ingested twice a day, the fill pattern may perform the appropriate mapping so that each labeled blister cell of the blister pack contains the appropriate combination of pills. A "morning" blister cell may be mapped to contain two pills, one of Prescription A and one of Prescription B. An "evening" blister cell may be mapped to contain only one of Prescription B's pills.

A pattern of filling a multi-dose container for one or more medications may be determined in view of such factors as the cubic volume of an individual pill, the prescribed or suggested dosage regime of each medication, the number of times a particular medication is to be ingested, etc. However, filling a multi-dose container such as a blister pack according to a determined pattern may not always produce the desired result due to the differences in volume, shape, and weight of the medication pills. For example, depositing a relatively small pill into a blister cell prior to depositing a relatively large pill into the same cell may result in an inefficient configuration of the pills in the cell. In particular, the larger pill may not fit into the cell, or may prevent another pill from fitting into the cell.

Moreover, filling a multi-dose blister pack may require complex manipulations of single-medication blisters or other sources. For example, a patient may be prescribed five types of medication to be ingested over the course of one or more weeks. The five types of medication may be available as pills in the form of capsules, tablets, etc., and may be packaged in single-medication blister cells or other types of containers. Preferably, a single weekly multi-dose blister pack can include all five prescribed medications which may be distributed among the cells of the blister pack according to a particular fill pattern. However, a single blister pack may not always accommodate all prescribed pills. The fill pattern may accordingly require multiple multi-dose blister packs. For example, a patient may have multiple "morning" blister packs and may need to open multiple individual blisters, one in each blister pack, at a particular time of day to retrieve all of the required medication, or may require an additional weekly card. Moreover, some of the pills of the same type may need to be distributed into multiple blisters. For example, the patient may be prescribed two dosages of a certain medication four times a day, and the medication may be available as a large pill. A system for determining a fill pattern (or a pharmacist) may determine that only one of the two pills can fit into an individual blister cell and, as a result, decide to place each of the two pills into separate blister packs. Thus, a filling unit or a pharmacist may retrieve medication from multiple sources at different stages of filling one or multi-blister packs. Depending on the order in which the system or pharmacist retrieves medication, each of the source containers may be accessed once or multiple times. In other words, the order of fill will frequently have direct impact on a number of operations performed while filling a prescription and, therefore, on the overall efficiency of prescription filling.

BRIEF SUMMARY OF THE DISCLOSURE

A method for determining an efficient order of filling a set of containers with medication, vitamin, or nutraceutical pills includes comparing one or more attributes of each pill and placing the pills into the set of containers based on the one or more compared attributes. In one aspect, a rule for generating an order of fill may be based on one or several attributes such as, for example, pill size, pill shape, pill color, pill compatibility, etc. In some embodiments, the method includes obtaining a cubic volume of each pill, obtaining a fill pattern mapping each pill to a corresponding container within the set, and sorting the pills by cubic volume to generate a fill order for the set of containers. In one aspect, each container is a cell of a multi-dose blister pack designed to hold multiple types of medication prescribed to or otherwise associated with a particular patient for a certain period of time. In general, a "multi-dose medicament container" as used herein may be an individually sealed receptacle that holds a set of medication pills corresponding to multiple prescriptions or non-prescribed dosages of a patient, usually (but not necessarily) on a per-ingestion time basis. Accordingly, a multi-dose blister pack may include multiple multi-dose medicament containers or "cells," so that a patient may open a single cell of a multi-dose blister pack at a particular time and ingest one or more medications stored in the cell. The cells of a multi-dose blister pack may be of an equal size or, according to other possible embodiments, some or all of the cells may differ according to, for example, an amount of medication to be deposited.

In an embodiment, the pills in a particular set are ordered in a descending order of cubic volume, so that the largest pill in the set is placed into a corresponding container first. In some embodiments, all pills in the generated order of fill are associated with a single set. In other embodiments, the generated order of fill includes multiple sets, each set sorted in the ascending order of cubic volume and corresponding to a particular multi-dose blister pack.

In another aspect, an individual pill may be described as a geometric solid such as a sphere, an ellipsoid with two or more unequal radii, a cylinder, or another shape common to prescription, over-the-counter, or vitamin pills, this solid having correspondence to the volume of the pill. In some of the embodiments which involve size-based ordering, the cubic volume of a pill is determined by multiplying the length, width, and height of a cuboid into which the pill may be inscribed. In some of the applications of the possible embodiments, the pills associated with different medications have different shapes. Additionally or alternatively, a medication having the same chemical composition may be provided in multiple shapes and/or sizes to facilitate allocating proper dosage for each prescribed or non-prescribed dosage regime with appropriate authorization. In some embodiments, the information pertaining to the cubic volume of each pill is stored in a database. In one such embodiment, the database may additionally store fill pattern information for one or more patients and blister size information for one or more blister pack configurations.

In some possible embodiments, the fill pattern specifies pill-to-cell mapping as well as pill-to-blister-pack mapping if the medication associated with a particular dosage regime does not fit into a single cell. A fill pattern consistent with this embodiment includes information regarding the number of blister packs required to package the necessary medication for a patient. In this sense, the fill pattern is explicit. In another embodiment, a fill pattern specifies the mapping of one or more pills to a blister cell which may not always accommodate all of the pills mapped to the cell. In this case, the method for generating an order of fill additionally may include the act of calculating a number of required multi-dose blister packs.

In accordance with some embodiments, a computer executes a software routine to generate a fill order based on the fill pattern and, in at least one embodiment, pill size information and communicates the generated order to an automated filling entity or to a human operator. In some embodiments, the computer may apply one or more rules to the pill information, each rule related to an aspect of generating an order of fill based on at least one pill attribute. The computer may be physically located at a pharmacy storefront, mail-order location or otherwise in physical proximity to a filling entity. Alternatively, the computer may be at another physical location or co-located with a web server so that communication with the filling entity is performed over a network. In another embodiment, a distributed system including one or more computing hosts such as operator workstations connected via an internet, an intranet, or any other type of a network may determine orders for fill for multiple patients. The computer may output the generated order on a monitor, send the order to a workstation via a network, or direct the order to a peripheral device such as a printer or a fax machine. In accordance with these embodiments, a human operator such as a pharmacist refers to the generated order during a manual process of filling one or more multi-dose blister packs. Alternatively, the operator may use a multi-dose filling machine capable of simultaneously depositing multiple pills from a single-medication blister pack into the corresponding cells of a multi-dose blister pack. In some embodiments, an operator may deposit source blisters into the machine according to the generated fill order.

In other embodiments, the method includes automatically placing the pills into containers according to the fill pattern and to the result of sorting. In particular, the method may employ an automated filling unit including a robotic arm working in co-operation with a conveyor belt. An intelligent host such as a computer may generate an order of fill based on the fill pattern and on the sizes of pills included in the fill pattern and communicate the order to the filling unit. Alternatively, the automated filling unit may include a processor, a memory, and a communications unit for retrieving fill patterns and/or pill size information from a database. Of course, these embodiments may not be advantageous in all situations because of a relatively high cost of robotic or otherwise fully automated approach.

In another aspect, the generated order of fill may correspond to a set of medication pills mapped to multiple multi-dose blister packs. In some embodiments, a separate order of fill is generated for each multi-dose blister pack to reduce a number of times a multi-dose blister pack is switched during a filling operation. In some embodiments particularly applicable to "time-of-day" blister packs (i.e., a blister pack corresponding to one particular time of day such as morning, with each cell corresponding to an individual day, week, etc.), the method includes iteratively stepping through each time of day, calculating a number of blister packs required, and sorting the pills associated with the time of day based on the cubic volume of each pill. In those embodiments that additionally include an act of placing the pills, the method includes, for each sorted list, iteratively stepping through the list and distributing one pill at a time to an appropriate blister cell of an appropriate blister card.

In another aspect, a method for determining an order of fill system may additionally generate an order of fill for an intermediate filling unit. In some embodiments, a storage unit such as a tote may include one or more of the intermediate filling units. In particular, the method may specify the order of filling an intermediate filling unit as a reverse order of filling the medicament containers. A filling unit or an operator may initially fill the intermediate filling unit according to the reverse order of fill and subsequently retrieve the pills from the intermediate filling unit in an opposite order. Thus, in one embodiment, the pills may be deposited into the intermediate filling unit in the descending order of cubic volume. In an alternative embodiment, the pills are deposited into the intermediate filling unit in the direct, or ascending, order of cubic volume. In some embodiments, the pills are deposited into and retrieved from the intermediate filling unit in single-medication blister packs.

DETAILED DESCRIPTION OF THE PREFERRED EMBODIMENTS

Although the following text sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Multi-dose medicament containers may be available in different types. For instance, a multi-dose blister pack may be one type of multi-dose medicament container used to fill a plurality of prescriptions or non-prescription pills for a patient. Examples of multi-dose blister packs may be found, for instance, in aforementioned U.S. Provisional Patent Application Ser. No. 60/947,169 entitled "Nested Multi-Dose Blister Pack." A medicament packet or pouch may be another type of multi-dose medicament container used to hold the set of pills to be ingested at a same time as prescribed by the patient's multiple prescriptions. Examples of individual packets/pouches may be found, for instance, in aforementioned U.S. patent application Ser. No. 11/741,539 and U.S. patent application Ser. No. 11/741,542. The disclosure of the present application may operate in accordance with these and other types of multi-dose medicament containers.

Figure 1:
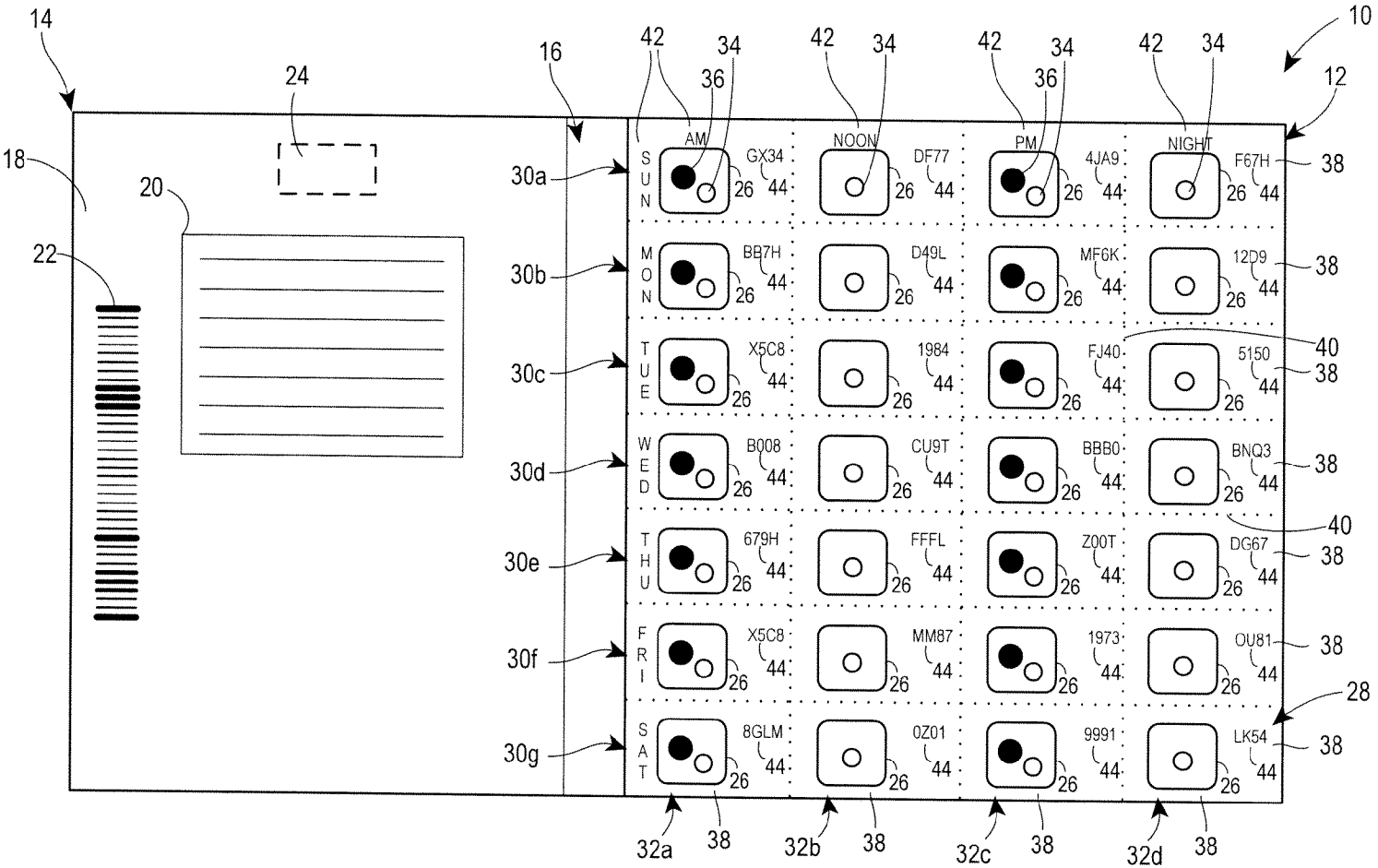
FIG. 1 illustrates an example multi-dose blister pack to which the system and method of the present disclosure may apply.

FIG. 1 depicts one embodiment of a multi-dose medicament container 10 that may be filled in an order of fill based on one or more rules which, in turn, are based on one or more pill attributes. In one particular example discussed in detail below, the fill rules are based a size of pills which may be determined in accordance with the present disclosure. It will be appreciated, however, that the rules may also be based on other attributes such as chemical weight, shape, chemical composition, manufacturer information, etc., and that FIGS. 6-11 illustrate a volume-based particular approach by way of example only. Also, it will be noted that the components and method discussed below with reference to FIGS. 6-11 apply to prescription medication, non-prescription medication, vitamins, nutraceuticals, or any combination thereof. Referring again to FIG. 1, the embodiment of the multi-dose medicament container 10 illustrated therein is also disclosed in U.S. Provisional Patent Application Ser. No. 60/940,790 entitled "Nested Multi-Dose Filling Machine and Process" and U.S. Provisional Patent Application Ser. No. 60/947,169 entitled "Nested Multi-Dose Blister Pack." The multi-dose medicament container 10 generally includes a multi-dose blister pack 12 and a cover 14, connected by a spine 16. In at least one embodiment, the multi-dose blister pack 12 is adapted to contain products such as prescription drugs or non-prescription medication, vitamins, or nutriceutricals, for example, for storage and ingestion by a patient. The cover 14 and spine 16 allow the package 10 to be closed similar to a book and may also contain identification information related to a prescription, the product stored in the multi-dose blister pack 12, and/or the patient. It is noted that numerous alternative designs for the product package exist, such as, for example, a tri-fold design or a wallet style, where the blisters are arranged to nest with one another when the package is folded.

In the disclosed embodiment, the cover 14 includes an inside surface 18 carrying a prescription label 20 and a product information/storage device 22. The prescription label 20 may include, for example, patient and/or prescription information, card number, order number. In an embodiment, this information may be related to the patient's course of treatment, a dosage amount, a frequency of dosage, side effect and overdose warnings, drug indications and interactions, benefits, and other information related to the drug and/or the course of treatment. Meanwhile, the product information identification/storage device 22 may include a product identification number, serial number, order number, etc. The product information identification or storage device 22 may include, for example, a bar code, a radio frequency identification (RFID) tag, or any other type of an electronic or textual identification. In general, the product information identification 22 may store a product number, a serial number, a store number, or information related to the course of treatment. It will be further appreciated that relevant information may be distributed between the prescription label 20 and the product information identification 22 in any desired manner, possibly including redundancy (i.e., duplication). Moreover, if desired, all of the relevant information may be stored in the product information identification 22, for example. Additionally, the depicted embodiment of the package 10 may include a timer 24 such as an electronic timer for signaling to a patient, for example, when to take his/her medication. In an embodiment, the timer 24 may shut off automatically to indicate compliance with the corresponding dosage regime. The timer 24 is depicted in phantom in FIG. 1 such that it may be understood that the timer 24 may be retained between multiple plies of the material forming the cover 14 such that a visual indicator such as a blinking light may be disposed on an outside surface of the cover 14. In another embodiment, the timer 24 may include an audible indicator such as a speaker for emitting a beep, for example, a physical indicator such as a vibrating device, or a visual indicator such as a flashing light of one or more colors. Although not depicted, it should be appreciated that alternative embodiments of the package 10 may include either or both of the prescription label 20 and the product information storage device 22 on an outside surface of the cover 14. So configured, such information may be readily attainable without having to open the cover 14.

The multi-dose blister pack 12 of the package 10 depicted in FIG. 1 includes a plurality of blisters 26 arranged in a matrix 28. Additionally, the multi-dose blister pack 12 includes a removable foil-backing material (not shown) on the backside of the blister pack 12 to seal the blisters 26. In general, the matrix 28 may correspond to any convenient arrangement of medication, vitamin, OTC, nutraceutical, or other type(s) of pills according to a particular dosage regime. For example, the matrix 28 may accommodate pills for a 30-day (i.e., one month) duration, with each individual blister corresponding of one of the days of the 30-day period and holding the one or several pills to be ingested during the day. In other words, the matrix 28 may define a convenient layout of a supply of pills for one month. Alternatively, the matrix 28 may correspond to a certain time of day (e.g., morning, noon, afternoon, a specified time such as 10:30 a.m., a specified window of time, etc) and may include pills for ingestion over a certain number of days during the same time of day. In yet another embodiment, the matrix 28 may be a two-dimensional array corresponding to several times of day over a period of several days. It will be appreciated that further variations are also possible. The matrix 28 of the particular embodiment depicted in FIG. 1 includes a four-by-seven matrix, signifying the seven days of the week and the four general times of the day. More particularly, the matrix 28 includes seven rows 30*a*-30*g*, each row assigned to one day of the week, i.e., "Sunday," "Monday," "Tuesday," "Wednesday," "Thursday," "Friday," and "Saturday." Additionally, the matrix 28 includes four columns 32*a*-32*d*, each column assigned to a distinct time of the day, i.e., "AM," "Noon," "PM," and "Night." Thus, in this particular embodiment, the multi-dose blister pack 12 may be described as a weekly pack additionally having time-of-day divisions.

Accordingly, the multi-dose blister pack 12 of FIG. 1 includes twenty-eight blisters 26, each containing a specified dose of one or more drugs for ingestion on that particular day, at that particular time. For example, as depicted, the blister 26 located at row 30*a* and column 32*d*, which corresponds to "Sunday," "Night," includes a single tablet 34. Thus, the patient that has been prescribed the multi-dose blister pack 12 knows to ingest tablet 34 during the "Night" on "Sunday." In contrast, blister 26 located at row 30*a* and column 32*c*, which corresponds to "Sunday," "PM," includes one tablet 34 and one tablet 36. Accordingly, the patient knows to ingest tablet 34 and tablet 36 in the "PM" on "Sunday." The multi-dose blister pack 12 depicted in FIG. 1 is only one example of how various drugs may be stored for a particular patient. It should be appreciated that the blisters 26 of the multi-dose blister pack 12 may contain generally any number of tablets for ingestion by the particular patient, in accordance with generally any prescription(s). The only limitation on the number of tablets or variations of prescriptions stored by the multi-dose blister pack 12 is the size of the individual blisters 26. Nevertheless, it is foreseeable that the principles of the present disclosure may be applied to multi-dose blister packs having blisters of generally any size and configuration.

Additionally, in the embodiment depicted in FIG. 1, the multi-dose medicament container 10 is designed to contain one or more prescriptions for a single week, i.e., seven days. Thus, a patient with a prescription or a dosage regime for a non-prescription medication that lasts more than a week may require multiple product packages, where each package 10 is assigned to a particular week. In other embodiments, the patient may similarly require multiple time-of-day or monthly containers 10.

With continued reference to FIG. 1, the multi-dose blister pack 12 includes a plurality of cells 38 that constitute the rows 30*a*-30*g* and columns 32*a*-32*d* of the matrix 28. Thus, each cell 38 accommodates a single blister 26. Additionally, in the disclosed embodiment, each of the cells 38 may be separated by perforated seams 40, which may have a single (e.g., vertical, horizontal, diagonal, circular, etc) or multiple orientations. So configured, a patient may remove one or more of the cells 38 including the cells' 38 respective blisters 26 from the multi-dose blister pack 12. This allows the patient to discard empty blisters 26 and/or to transport one or more blisters 26 without having to transport the entire package 10. Alternative embodiments may not include perforated seams 40.

Additionally, as depicted in FIG. 1, each cell 38 includes indicia 42 indicating to the patient when to ingest the tablets stored in the particular blister 26. For example, the blister 26 located at row 30*a* and column 32*d* includes indicia 42 identifying "SUN" for Sunday at the left portion of row 30*a*, and "Night" for night-time at the top portion of column 32*d*. The remaining cells 38 have similar indicia for different days of the week and times of the day. Accordingly, in one embodiment of the present disclosure, while the multi-dose blister pack 12 is unique for every patient, there may be many similarities from one patient's multi-dose blister pack to the next. So configured, not necessarily every blister 26 must be filled for a specific prescription to be satisfied. For example, for a 6-day prescription that begins on Monday and ends on Saturday, the multi-dose blister pack 12 would not include tablets stored in the blisters 26 for Sunday. For a 7-day prescription that begins on Monday and ends on Sunday, a patient may be given two packages 10. The multi-dose blister pack 12 of the first package 10 could include tablets in the blisters 26 only for Monday through Saturday, while the multi-dose blister pack 12 of the second package 10 would only include tablets in the blisters for Sunday, for example. If desired, a customized multi-dose blister pack 12 may correspond to a particular short-term course of medication and may begin and end on any day of the week. As yet another alternative, the multi-dose blister pack 12 may conform to a standard template (e.g., weekly, monthly, etc.) but may have customized labeling according to the needs of a particular patient.

However, an alternative embodiment of the package 10 may include a customized multi-dose blister pack 12 for each patient. For example, for a patient receiving a 7-day prescription that begins on Tuesday, for example, the indicia 42 on the multi-dose blister pack 12 may be printed specifically for that prescription. Thus, each cell 38 in the first row, which is identified by reference numeral 30*a* in FIG. 1, may be printed with indicia identifying Tuesday. Similarly, the second row 30*b* would include indicia identifying Wednesday, the third row 30*c* including indicia identifying Thursday, etc. The same type of customized indicia could also be applied to the specific times of the day that the particular drugs are to be taken. For example, if a certain medication must be taken "With Breakfast," for example, the cells 38 in column 32*a* may include indicia reflecting such a prescription. In at least one embodiment, the customized indicia may include a compliance code 44. The compliance code 44 may be associated with any subset of the blisters 26 and may be used, for example, to prove compliance of the patient with a certain aspect of the prescribed dosage regime. More specifically, a dedicated web site or another type of an automated system may issue reminders to the patient to ingest certain medication at a time consistent with the prescribed dosage regime. The patient may then acknowledge the reminder and/or confirm his or her compliance by submitting the corresponding compliance code 44 to the website or to the system.

Methods and systems for filling multi-dose medicament containers are also known in the art. Aforementioned U.S. Provisional Patent Application Ser. No. 60/940,790 entitled "Multi-Dose Filling Machine and Process" discloses a system, or filling entity, for filling a multi-dose blister pack by using a press and one or more transfer fixtures. Said system uses intermediate cards containing single doses of prescribed medications to transfer pills into multi-dose blister packs. Other filling entities and methods for medicament pouches and other types of multi-dose medicament containers are also known in the art. A filling entity may be a mechanical system that is entirely automated by a computer network, it may be an entirely manual system with one or more human beings performing the filling of the prescriptions, or it may be some combination of automated and manual. The disclosure of the present application may also operate in accordance with these and other systems, entities, and methods for filling multi-dose medicament containers.

Figure 2:
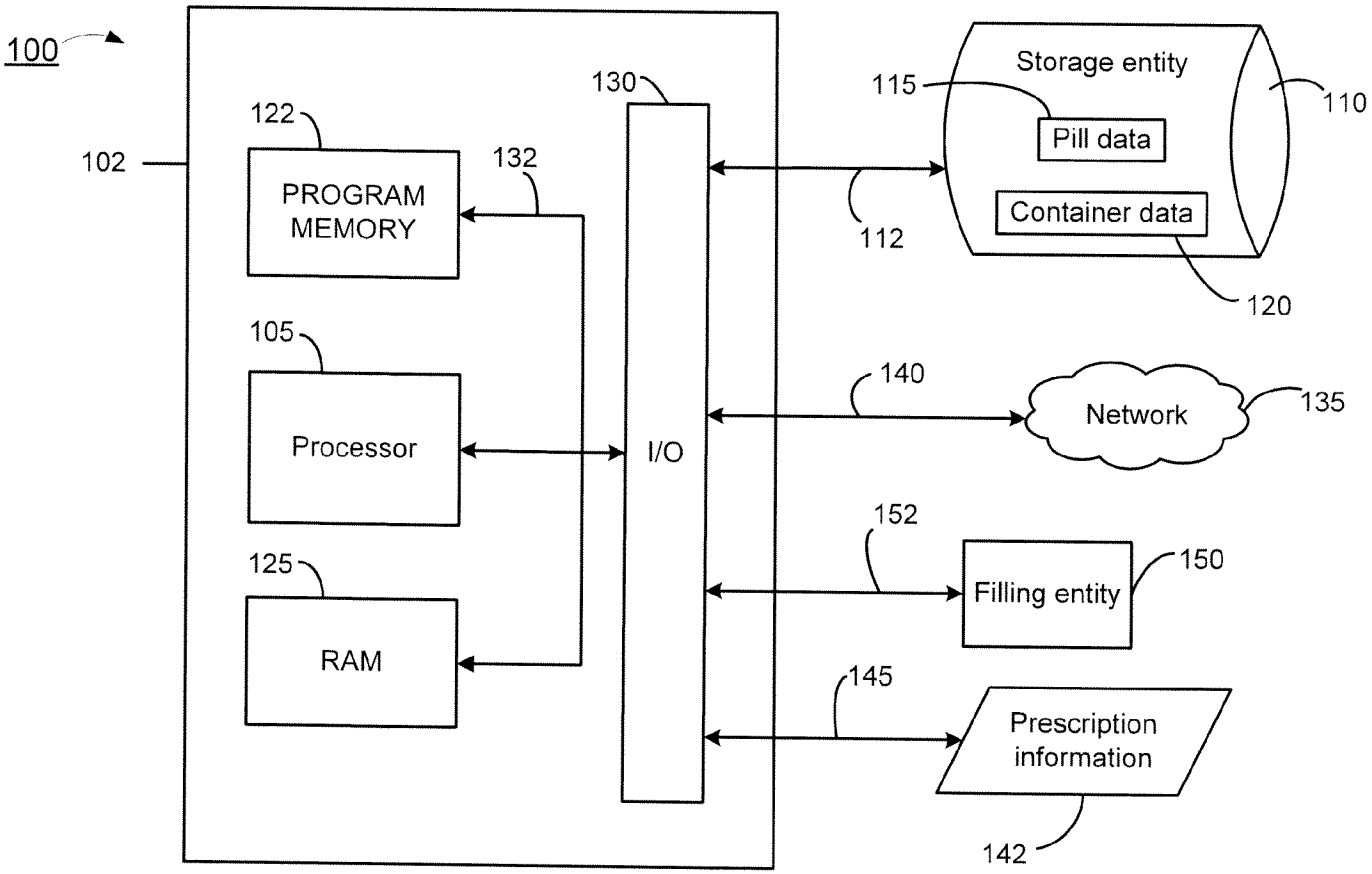
FIG. 2 illustrates an example embodiment of a system for determining and communicating an order of fill of a multi-dose medicament container.

FIG. 2 is an embodiment of a system 100 for determining and communicating an order of fill and/or a volume-based or another type of a fill pattern of a multi-dose medicament container. For the sake of illustration, a simplified block diagram of a computer 102 is used to illustrate the principles of the instant disclosure. However, such principles apply equally to other electronic devices, including, but not limited to, cellular telephones, personal digital assistants, media players, appliances, gaming systems, entertainment systems, set top boxes, and automotive dashboard electronics, to name a few. The computer 102 may have a processor 105 that is operatively connected to a database or storage entity 110 via a link 112. Link 112 may be as simple as a memory access function, or it may be a wired, wireless, or multi-stage connection through a network. Many types of links are know in the art of networking and are possible. Alternatively, the storage entity 110 may be contained in the same entity as the computer 102. It should be noted that, while not shown, additional databases may be linked to the computer 102 in a known manner. The storage entity 110 may include any data that may be relevant to determining a fill pattern and an order of fill for a multi-dose medicament container, such as but not limited to pill data 115 and container data 120. Additionally, the storage entity 110 may store one or several rules for generating the order of fill. These rules may be represented in any suitable format such as a series of computer instructions defining a script for example.

Pill data 115 may contain facts about pills that are available to be prescribed. The pill data 115 may include pill identification information, such as trade name, generic name, chemical composition, dosage units, and the like. The pill data 115 may also contain physical attributes, such as length, width, height, diameter, weight, form (such as tablet, gel, chewable) and the like. Container data 120 may contain facts about the containers, such as but not limited to: type, dimensions, volume, material from which it is made, whether or not there are multiple receptacles in the container and if so, how many and what size, etc. Pill data 115 and container data 120 may be obtained by the computer 102 through a download, data transfer, or other such mechanism. Alternatively, the computer 102 may request or read the storage device 110 to obtain only the specific pill data 115 and container data 120 that it needs to fill a specific set of prescriptions.

Additionally, pill data 115 may include derived attributes such as a cubic volume of some or all available pills. In one contemplated embodiment, the computer 102 or another component of the system 100 may calculate the cubic volume of a particular pill by multiplying the length, width, and height attributes of the pill. This method of calculating volume may apply to a pill shaped substantially like an ellipsoid, sphere, elongated cylinder, etc. It will be appreciated that the system 100 may also selectively use other methods of approximating the cubic volume of a pill. For example, the system 100 may check the one or more attributes indicative of the shape of the pill and, if the pill is a cylinder or a cylinder having rounded ends, calculate the cubic volume by multiplying the height of the cylinder by the cross-sectional circular or elliptical area. One of ordinary skill in the art will further appreciate that other methods of estimating the volume are also possible, including those yielding the relatively precise volume of each pill by applying relatively complex formulas or algorithms. Moreover, the system 102 may receive the derived attributes included in the pill data 115 from a pharmacist or pharmacy technician via a pharmacy computer, for example. In yet another contemplated embodiment, an automated Vision system (e.g., a robotic system capable of recognizing shapes, reading barcodes, or both) may supply some or all of the pill attributes to populate or supplement the pill data 115.

The computer 102 may include a processor 105 (may be called a microcontroller or a microprocessor) for executing computer executable instructions, a program memory 122 for permanently storing data related to the computer executable instructions, a random-access memory (RAM) 125 for temporarily storing data related to the computer executable instructions, and an input/output (I/O) circuit 130, all of which may be interconnected via an address/data bus 132. It should be appreciated that although only one processor 105 is shown, the computer 102 may include multiple processors 105. Similarly, the memory of the computer 102 may include multiple RAMs 125 and multiple program memories 122. Although the I/O circuit 130 is shown as a single block, it should be appreciated that the I/O circuit 130 may include a number of different types of I/O circuits. The RAM(s) 125 and program memories 122 may be implemented as semiconductor memories, magnetically readable memories, and/or optically readable memories, for example. The computer 102 may also be operatively connected to a network 135 via a link 140. Similar to link 112, the form of link 140 may take any form known in the art of networking.

As indicated above, pill data 115 may include derived attributes such as a cubic volume of some or all available pill types and, in at least one contemplated embodiment, the computer 102 or another component of the system 100 may calculate the cubic volume and/or other attributes of a particular pill. Alternatively, an operator may manually populate some or all of the derived attributes.

The computer 102 may receive prescription information 142 over a link 145. Link 145 may be the same entity as network link 140 or database link 112, or it may be a separate entity. Link 145 may be an operator/user interface, or it may be a local or remote network connection to a server, website, other computer, or a different database. The computer 102 may receive prescription information 142 from a plurality of sources, for example, when a single computer 102 receives prescription information 142 from multiple medical entities such as doctors' offices, hospitals, and the like. In this case, multiple links 145 are possible.

The computer 102 may also be operatively connected to a filling entity 150 via a link 152 for communicating fill patterns. Filling entity 150 may dispense medications according to the fill pattern received from computer 102 so that the prescription(s) are filled into one or more multi-dose medicament containers. As discussed in greater detail below, a fill pattern may specify, for example, pill-to-cell mapping (i.e., a mapping between each pill and a particular cell or blister of a multi-dose blister pack 12). In other embodiments, the fill pattern may only specify pill-to-blister-pack mapping. Filling entities 150 may be automatic processes or systems, they may be manual, or some combination of the two. Multiple links 152 to multiple filling entities 150 may be possible, for instance, if separate filling entities exist for different types of medicament containers, or if a single computer 102 determines fill patterns for multiple pharmacy storefronts, each with its own filling entity 150. Link 152 may be the same link as links 112, 140 or 145, or it may be a separate link. Link 152 may also be a local connection or a remote connection through network 135.

Figure 3:
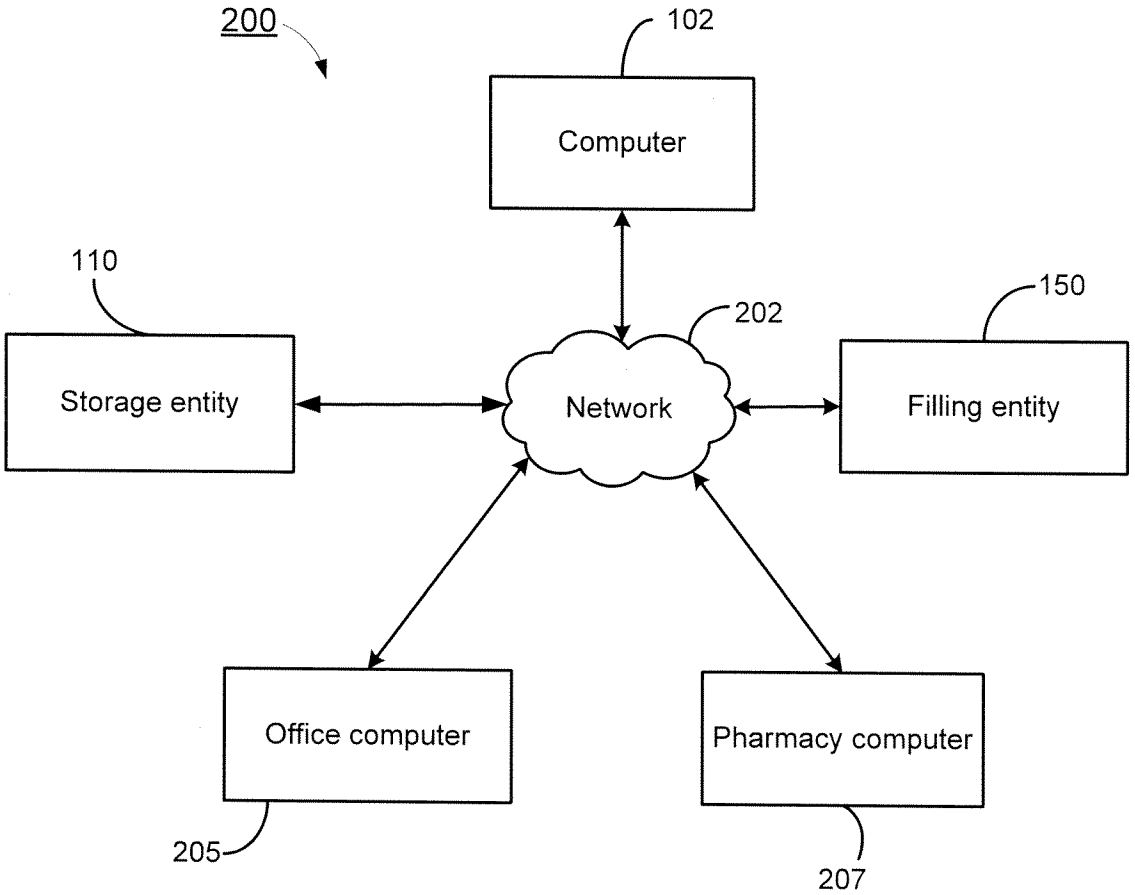
FIG. 3 illustrates an alternate embodiment of the system distributed in a network.

FIG. 3 illustrates an alternate embodiment of the system 200 distributed in a data network 202. The network 202 may be provided using a wide variety of techniques well known to those skilled in the art for the transfer of electronic data. For example, the network 202 may comprise dedicated access lines, plain ordinary telephone lines, satellite links, combinations of these and any other component to facilitate the communication of information between a plurality of network nodes. Additionally, the network 202 may include a plurality of network computers or server computers (not shown), each of which may be operatively interconnected in a known manner. It will be also appreciated that some or all of the components 102, 110, 150, 205 and 207 may be interconnected in any other method of communication, including the methods currently known in the art. Where the network 202 comprises the Internet, data communication may take place over the network 202 via an Internet communication protocol. Data sent over network 202 may be encrypted for security and privacy purposes.

In an embodiment, the computer 102 may take the form of a server computer, as commonly known in the networking art. For instance, if computer 102 is a website server, a medical professional may access the website hosted by computer 102 from their own local office computer 205 in order to enter a patient's prescription information for filling.

The computer 102 may communicate via network 202 to other entities. The computer 102 may receive prescription information via network 202 from an office computer 205 or pharmacy computers 207. Office computers may be located in doctors' offices, hospitals, or other medical facilities. Pharmacy computers may be located in a pharmacy storefront, hospitals, a distribution center such as for a mail-order pharmacy or other facilities that dispense medication. The computer 102 may access a database or storage entity 110 via network 202 to obtain pill data and container information, and communicate desired fill patterns to filling entity 150 via network 202.

Although only one computer 102, office computer 205, pharmacy computer 207, storage entity 110 and filling entity 150 are illustrated in FIG. 3, it should be understood that different numbers of computers 102, 205, 207, databases 110 and filling entities 150 may be utilized. For example, the network 202 may include a plurality of computers 102 and hundreds of offices 205 and pharmacies 207, all of which may be interconnected via the network 202. Multiple databases 110 may be employed for data storage. In some embodiments, an implanted patient-specific microchip (not shown) may be used to store patient data including but not limited to prescription information, drug interaction warnings, etc. and, in at least some of these embodiments, the chip may interact with one or more of the components 102, 110, 150, 205, or 207. Multiple filling entities 150 may be served. According to the disclosed example, this configuration may provide several advantages, such as, for example, enabling load distribution of determining fill patterns across several computers 102, or enabling near real time uploads and downloads of information as well as periodic uploads and downloads of information for batch processing. This may provide for a primary backup of all the information generated in the process of updating and accumulating filling pattern data.

In operation, the system 100 may determine or receive a fill pattern for a multi-dose medicament container such as a multi-dose blister pack. In particular, the system 100 may refer to prescription information 142, pill data 115, container data 120, etc. to generate a mapping of prescribed pills to the individual cells of one or more multi-dose blister packs. The computer 102 may store the generated fill pattern in a temporary memory location in the RAM 125 or in the storage entity 110. Although the system 100 may also communicate the fill pattern to a pharmacist via the office computer 205 without storing the fill data within the system 100, the computer 102 preferably retains the generated fill pattern in the RAM 125 for at least the duration of a procedure generating the order of fill. Alternatively, the system 100 may receive a fill pattern from a pharmacist using the pharmacy computer 207 or from another system or entity via the network 202. With respect to the procedure responsible for generating the order of fill, it will be noted that this procedure may apply one or more rules based on, for example, pill size, pill shape, pill compatibility (i.e., potential interaction if placed in the same container), etc. Further, the rules may be based on a single attribute or may include compound conditions based on several attributes (e.g., size and shape). Although the examples below illustrate the techniques for generating an order of fill based on pill size and, more specifically, on pill cubic volume, the system 100 may similarly apply other rules based on other attributes. Of course, these rules may apply to generating a fill pattern, generating an order of fill, or both.

As discussed above, a fill pattern for a certain patient may specify a mapping of medication pills to cells of one or more multi-cell blister packs. In some embodiments, a fill pattern may include precise mapping of each pill to a particular cell of a particular multi-cell blister pack. In other embodiments, a fill pattern may include only pill-to-cell mapping but not pill-to-pack mapping. For example, a patient may have a long-term prescription for two daily dosages of each of the medications A, B, and C, and for a single daily dosage of each of the medications D and E. A precise fill pattern associated with pill-to-cell mapping of a multi-pill prescription to several time-of-day multi-dose blister packs may include the following information:

| Morning Pack 1 | Morning Pack 2 | Night Pack |
|---|---|---|
| A, B, C, D | E | A, B, C |

Of course, a fill pattern could similarly specify mapping to another type of a blister pack such as one or several weekly multi-dose blister packs 12 illustrated in FIG. 1. In the example illustrated above, the pattern may be based on the cubic volume of each of the medications pill types A-E and on the cubic volume of an individual cell or blister. In accordance with this fill pattern, the filling entity 150 may place the morning pills into two multi-dose blister packs and the night pills into a single multi-dose blister pack. The pills corresponding to the medications A-D may fit into a single cell of a multi-dose blister pack; however, the medication E may require a separate cell or, if desired, may be packaged alone in a separate pack in accordance with a patient's preference, for example, or due to some other reason.

Alternatively, an optimized fill pattern corresponding to the same set of prescriptions may map the five prescribed medications in such a way as to reduce the number of required multi-dose blister packs:

| Morning Pack | Night Pack |
|---|---|
| A, B, C, D | A, B, C, E |

In this example, the system 100 or an external device or operator generating the fill pattern may place the pill corresponding to the medication E into the night pack instead of the default morning pack as long as ingesting the medication E at night is in compliance with the corresponding prescription directions. As in the example utilizing two morning packs and one night pack, each cell may hold one pill of each of the types A-D, and a cell of a similar night-time pack may hold one pill of each of the types A-C and E.

In another embodiment, the fill pattern may indicate only the mapping of the pills to the blister packs without specifying the individual cells or the number of required blister packs:

| Morning | Night |
|---|---|
| A, B, C, D, E | A, B, C, E |

In this sense, this type of fill pattern may correspond to a higher level of logic, i.e., to pill-to-card mapping rather than to pill-to-cell mapping. To fill the prescriptions A-E in accordance with this pattern, the filling entity 150 may determine the number of required blister packs in the course of placing pills into the blister pack cells. In other words, the fill pattern need not necessarily specify the precise pill mapping and, more generally, may contain a higher or lower level of detail depending on the embodiment.

Figure 5:
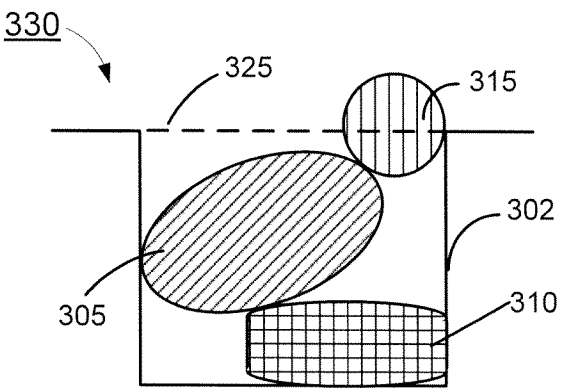
FIG. 5 illustrates an alternative configuration of the same medication pills as illustrated in FIG. 4 in a similar container.
Figure 4:
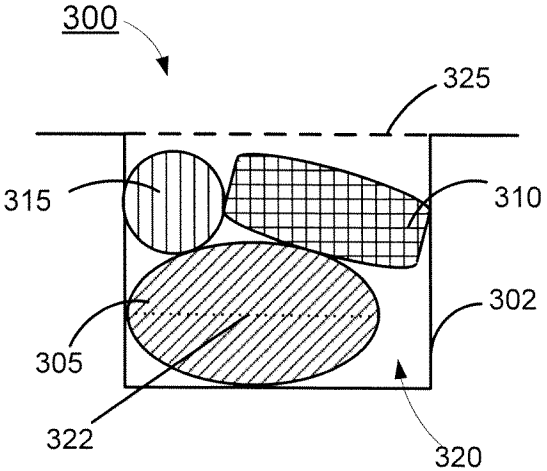
FIG. 4 illustrates an example configuration of several medication pills in a container generated according to the methods of the present disclosure.
Figure 6:
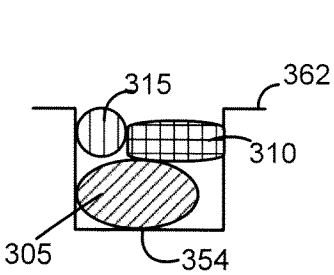
FIG. 6 illustrates an example configuration of several medication pills in several cells of a multi-dose blister pack generated according to the methods of the present disclosure.
Figure 6:
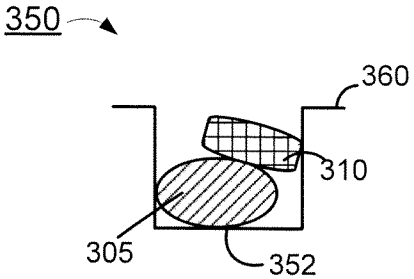

Referring to FIG. 4, a configuration 300 corresponds to a container 302 efficiently storing pills 305-315. By way of illustration, a technique of determining the order of fill based on pill volume is discussed below with reference to FIGS. 4-6. However, it will be appreciated that the order of fill may similarly be based on other attributes, and that FIGS. 4-6 illustrate only one example of determining an efficient order of fill. More specifically, the container 302 may be a cell of a multi-dose blister pack holding pills associated with the same time of day, or multiple times of day of the same week or month, or according to any other principle of organizing pills that a patient may find convenient. A filling pattern may map the pills 305-315 to the same time of day and may additionally require that the pills 305-315 be deposited into a single container. Although illustrated as a standalone unit, it will be appreciated that the container 302 may be physically connected to one or more blisters and, moreover, that the container 302 may be easily detachable from the corresponding blister pack (not shown) for individual carrying, storage, and usage. The container 302 may have an available volume 320 for holding medication, which the system 100 may store as part of container data 120. It will be noted that the volume 320 may be variable, and that in some embodiments, a single multi-dose blister pack may include blisters having different volumes 320. Further, two blisters associated with a same multi-dose blister pack 320 and having the same volume 320 may have different shapes due to a difference in width, length, shape, etc. To take one specific example, the morning blister of a certain weekly multi-dose blister pack may be larger than the morning blister of the same pack.

In the example illustrated in FIG. 4, the pill 305 may be a relatively large capsule. In particular, the pill 305 may be an ellipsoid having three non-equal radii. The pill data 115 may accordingly include a relatively large value corresponding to the approximate cubic volume of the pill 305. Meanwhile, the pill 310 may be a tablet shaped substantially as a disk. In this example, the cubic volume of the pill 310 may be smaller than the cubic volume of the pill 305. However, it will be appreciated that one or even two dimensions of the pill 310 may be larger than the corresponding one or two dimensions of the pill 305.

With continued reference to FIG. 4, the pill 315 may be a spherical pill having the smallest volume. Additionally, it will be appreciated that the pills 305-315 may have other regular or irregular shapes. Similarly, the container 302 may have any shape or form and, depending on the embodiment, may be able to hold one or more of each of the pills 305-315.

In this example arrangement, the filling entity 150 first deposits the largest pill 305 into the initially empty container 302. In other words, the filling entity 150 may execute a rule which requires, subject to one or more possible exceptions, placing larger pills into a container prior to placing smaller pills into the container. As discussed in a cited related application, the filling entity 150 may optionally shake or tilt the container 302 to ensure that the pill 305 resides in the container 302 in an optimal manner. In particular, a shaking motion may ensure (or, at least, increase the probability) that the largest dimension 322 of the pill 305 is aligned with the floor of the container 302. Of course, the floor of the container 302 may also be concave or otherwise non-linear, in which case the filling entity 150 may shake the container 302 to ensure that the pill 305 resides in a most stable configuration. Next, the filling entity 150 may deposit the second largest pill 310 into the container 302. The filling entity 150 may similarly shake or tilt the container 302 to minimize the space occupied by the pills 305 and 310 and to achieve the most stable configuration of the pills 305 and 310 prior to adding the final pill 315 to the container 302. Finally, the filling entity 150 places the pill 315 into the container 302 and, optionally, shakes the container 302.

Thus, as illustrated in FIG. 4, the pills 305-315 are advantageously placed into the container 302 in a descending order of cubic volume. A cover 325 made of foil or thin plastic film, for example, may properly fit over the container 302. By contrast, a configuration 330 illustrated in FIG. 5 corresponds to an alternative order of placement of the same set of pills 305-315 into the same container 302. In particular, the second-largest pill 310 is deposited into the container 32 first and the largest pill 305 is deposited second. As evident from the schematic illustration, the resulting arrangement prevents the cover 325 from properly closing because the pill 315 does not completely fit into the container 302. At this point, it will be noted that in some situations, a different order of placing the pills 305-315 into the container 302 may be optimal. If, for example, the pills 305-315 may fit into the container 302 irrespective of whether the largest pill 305 is deposited into the container 302 prior to the smaller pills and if, to continue with this example, the filling entity 150 requires an extra operation to obtain the largest pill 305, the optimal order of fill may then correspond to the order in which the filling entity 150 may obtain the pills 305-315. More generally, it will be appreciated that the order of fill may be optimized in view of various factors including but not limited to pill size, the availability of pills at the filling entity 150, etc.

Generally in regard to a set of pills mapped to a container, the computer 102 or another component of the system 100 may sort the set of pills according to the cubic volume of each pill to obtain an ordered list. The computer 102 may receive a fill pattern for a certain patient, retrieve all or relevant parts of the pill data 115 from the storage entity 110 to obtain a cubic volume for each of the relevant pill types, and organize the cubic volumes values in an ascending or descending order. One of ordinary skill in the art will appreciate that the computer 102 may apply any of the well known sorting techniques to efficiently arrive at an organized list. Further, it will be appreciated that the organized list may be stored as an array, linked list, or any other suitable data structure. In accordance with one possible embodiment, each element of the list may be a substantially unique identifier of each pill type. The identifiers may be efficiently stored in the RAM 125 as small integers, for example. In another embodiment, the system 100 may physically sort the set of pills using a robotic arm or other automation means.

It is additionally contemplated that a single fill pattern may correspond to multiple sorted lists, especially if the fill pattern is complex and involves multiple cards. Referring to an example configuration 350 illustrated in FIG. 6, both cells 352 and 354 may correspond to the same dosage regime for the same patient. For the sake of simplicity, FIG. 6 illustrates only the relevant portions of two multi-dose blister packs 360 and 362 which include the cells 352 and 354, respectively. The patient may take medication from both blister packs 360 and 362 four times a day, for example, and the cells 352 and 354 may hold the morning dosage. As illustrated in FIG. 6, the morning dosage may include two pills 305, two pills 310, and one pill 315. The corresponding fill pattern may map one of each of the pills 305-315 to the container 354 and the second pill 305 along with the second pill 310 to the container 352. Thus, to optimally utilize the available volume of the cells 352 and 354, the pills must be deposited into these cells in an efficient order.

To this end, the computer 102 may generate separate fill orders for the container 352 and 354. In particular, the fill order may specify that the container 352 of the blister pack 360 must receive the pill 305 followed by the pill 310 (i.e., in a descending order of cubic volume of the pills 305 and 310). Another fill order may specify that the container 354 must receive the pill 305 followed by the pill 310 followed by the pill 315. The filling entity 150 or an operator may completely fill the cell 352 prior to filling the cell 354. Alternatively, the filling entity 150 may deposit each of the two pills 305 into the cells 352 and 354, then deposit each of the two pills 310 into the cells 352 and 354, and finally deposit the pill 315 into the cell 354. Thus, in the example configuration 350, the fill order may include either two lists, each organized in the ascending order by cubic volume, or a single list for both cells 352 and 354. Of course, the filling entity 150 may need to switch the target blister packs 360 and 362 several times when filling the prescriptions according to a single fill order.

To further illustrate the concepts discussed above, FIG. 7 includes a schematic representation of an example fill order 400. As indicated above, the fill order 400 may correspond to a logical representation of pills stored as digital data in the RAM 115, or to a physical arrangement of pills in a temporary container which may be referred to herein as an intermediate filling unit. In some embodiments, the intermediate filling unit may be a unit-dose blister. In other embodiments, the intermediate filling unit may be a plastic tube or a box for example, which is preferably sterile and generally suitable for coming into direct physical contact with pills. In these and other embodiments, one or several intermediate filling units may fit into a "tote," or another level of a container. It will be understood that a temporary filling unit of the present disclosure may correspond to any level of nesting of containers used in filling multi-dose blister packs. In either case, the pills may be placed into an intermediate filling unit at an intermediate step in filling the prescription according to a specified fill pattern. A technician or an automated component of the system 100 may, for example, pick the pills into the intermediate filling unit in an order opposite to the fill order. At the subsequent stage, the filling entity 150 may sequentially retrieve the pills from the intermediate filling unit and deposit the pills into the cells of one or more blister packs in the order of retrieval from the intermediate filling unit.

Figure 7:
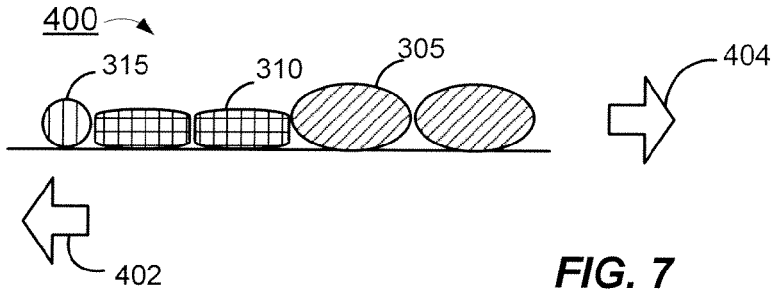
FIG. 7 schematically illustrates an order of fill of an intermediate filling unit and medication containers generated according to the methods of the present disclosure for a certain set of pills.
Figure 8:
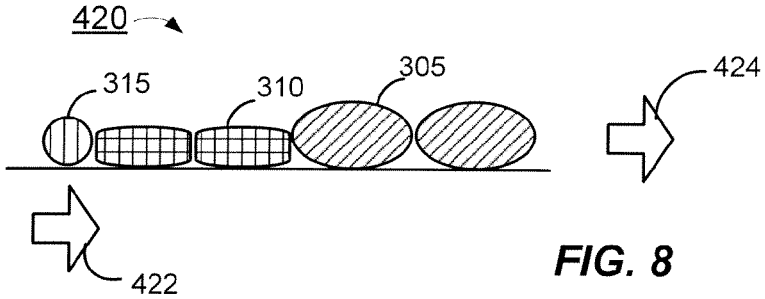
FIG. 8 schematically illustrates an order of fill of an alternative type of an intermediate filling unit and medication containers generated according to the methods of the present disclosure for a certain set of pills.

In the case illustrated in FIG. 7, the intermediate filling unit is filled in the order indicated by the arrow 402 and emptied in the order indicated by the arrow 404. Thus, the filling entity 150 may first deposit the smaller pill 315 into the intermediate filling unit, followed by the larger pills 310, and further followed by the largest pills 305. One of ordinary skill in the art will recognize that the intermediate filling unit consistent with this illustration implements a first-in-last-out queuing technique. Alternatively, an intermediate filling unit may be consistent with a first-in-first-out technique, as illustrated in FIG. 8. The fill order 420 may require filling the intermediate filling unit in the direction indicated by the arrow 422 and emptying the intermediate filling unit in the order indicated by the arrow 424. Thus, the largest pills 305 may be deposited into and retrieved from the intermediate filling unit prior to the smaller pills 310 and 315.

Figure 9:
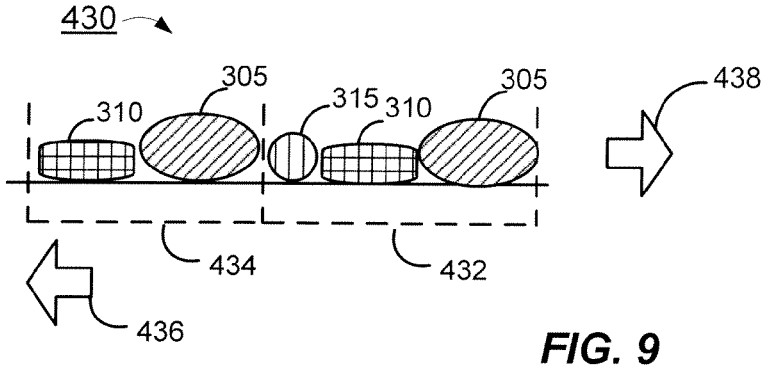
FIG. 9 schematically illustrates an alternative order of fill of an intermediate filling unit and medication containers generated according to the methods of the present disclosure for a certain set of pills.

Referring back to FIG. 6, the filling entity 150 may fill the containers 352 and 354 according to the fill order 400 or 420. The corresponding intermediate filling unit may be filled in the direction of the arrows 402 or 422 and emptied in the direction of the arrows 404 or 424. Because the containers 352 and 354 may be cells of separate blister packs 360 and 362, the filling entity 150 may fill the two blister packs substantially in parallel when following the fill order 400 or 420. On the other hand, the fill order 430 may include separate sub-orders 432 and 434 corresponding to separate blister packs of a certain fill pattern (FIG. 9). Unlike the example fill orders 400 and 420, the fill order 430 may require filling the containers 352 and 354 consecutively. The filling entity 150 may need to first deposit the larger pill 305, followed by the smaller pills 310 and 315, into the container 354 according to the sub-order 432. Next, the filling entity 150 may deposit the pills 305 and 310 into the container 352 according to the sub-order 434. To this end, the corresponding intermediate filling unit may be filled in the direction of the arrow 436 and emptied in the direction of the arrow 438.

Figure 10:
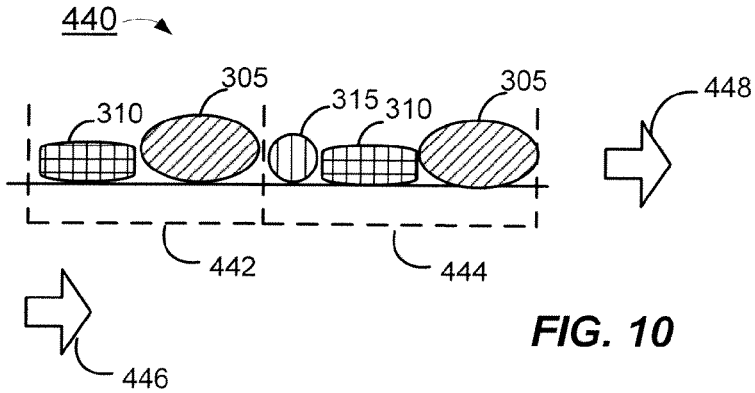
FIG. 10 schematically illustrates an alternative order of fill of another type of an intermediate filling unit and medication containers generated according to the methods of the present disclosure for a certain set of pills.

FIG. 10 illustrates yet another scheme 440 consistent with the contemplated embodiments of the system 100. The scheme 440 is similar to the scheme 430 in that separate sub-orders 442 and 444 correspond to the containers 352 and 354, respectively. However, the scheme 400 corresponds to an alternative type of an intermediate filling unit which may be filled in the direction of the arrow 446 and emptied in the direction of the arrow 448.

Generally with respect to FIGS. 4-10 discussed above, one of ordinary skill in the art may recognize that placing a set of pills into a container according to the cubic volume alone may not always result in the best possible configuration. In particular, a certain pill, due to its shape, may obstruct a large part of a container if deposited over another pill. Even more specifically, this pill may have a narrow long profile resulting in a relatively low cubic volume. Despite the cubic volume measurement of the pill, an optimal order of fill may require placing the pill into the container prior to all other pills. The system 100 may thus include other factors in determining an optimal order of fill, such as considering one or more of the pill's dimensions (length, width, etc.) or deriving additional attributes such as a diagonal connecting two opposite corners of the corresponding circumscribing cuboid. In general, the system 100 may apply a variety of arithmetic or modeling techniques to further improve the fill order. Further, the system 100 may employ various techniques of physical manipulation of pills or the containers for the purpose of compactly settling the pills such as, for example, vibrating the container.

Figure 11:
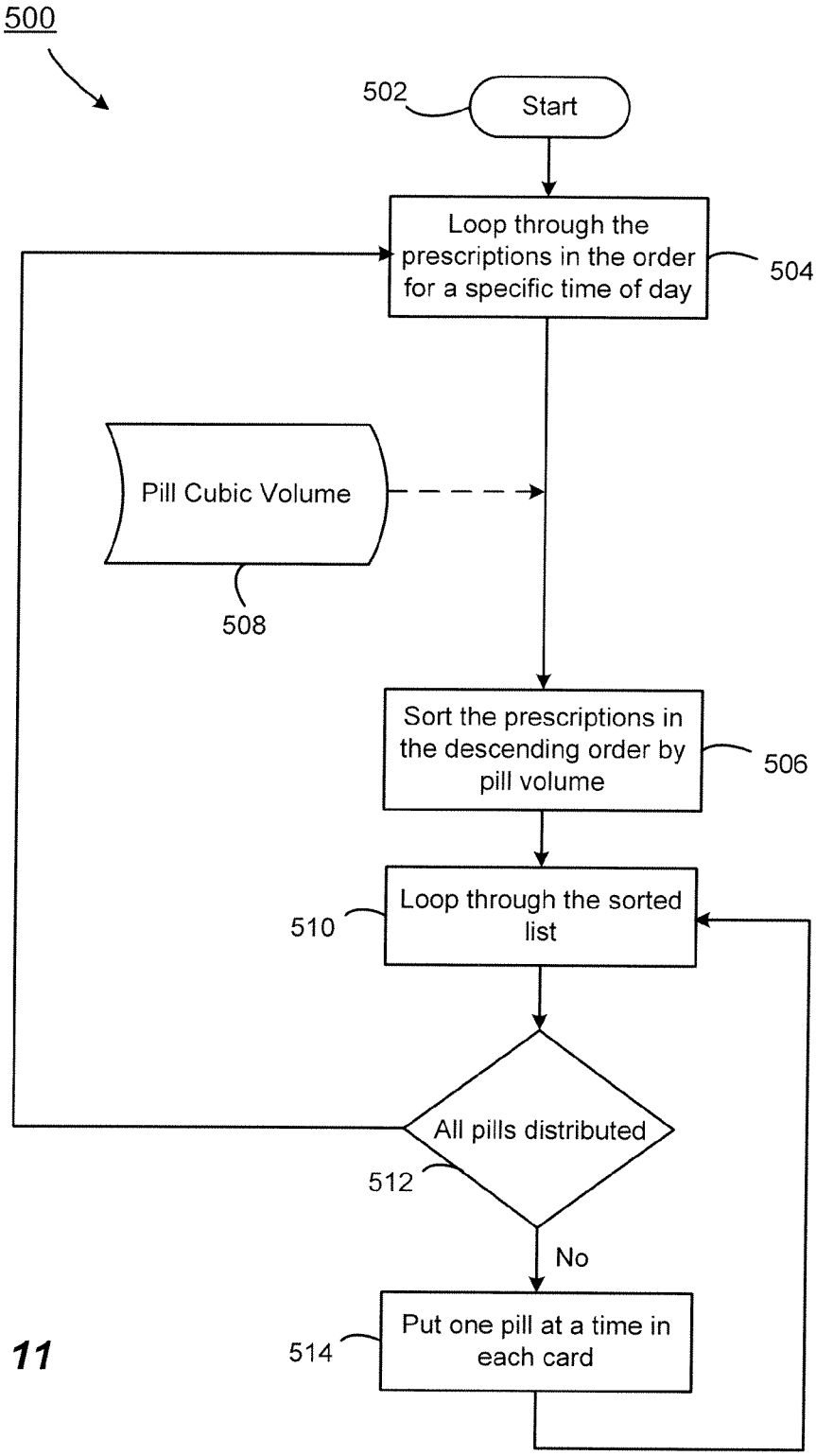
FIG. 11 is a flowchart illustrating an example procedure of generating an order of fill for determining an order of fill for a plurality of medication pills in a multi-dose medicament container and depositing pills according to the generated order.

FIG. 11 illustrates an example procedure 500 for generating a fill order and filling one or more multi-dose blister packs in accordance with the generated fill order based on pill volume. The computer 102 may execute all or part of the procedure 500 as a set of computer instructions, or the procedure 500 may run on one more components of the system 102 in a distributed manner. Further, the filling entity may execute at least some of the steps of the procedure 500 and, to this end, may cooperate with the computer 102 or another component in real time or in an asynchronous manner. The procedure 500 begins by retrieving a fill pattern or, at least, the information identifying the set of prescribed medications for a particular patient (block 502). The fill pattern may indicate, for example, that that the patient must ingest several types of medications several times a day. In some cases, the fill pattern may specifically map each type of a medication pill to a particular part of day. Of course, not every medication pill needs to have the same duration of prescription as the rest of the pills, nor do the medication pills need to begin on the same day.

The procedure 500 may begin to loop through the fill pattern or the set of medication pills for a specific time of day (block 504). Of course, the procedure 500 may alternatively loop through the fill pattern for a particular week, month, or other parameter. Next, the procedure 500 may sort the prescriptions associated with the particular time of day (block 506) upon obtaining the cubic volume for each relevant pill (block 508). In some embodiments, the procedure 500 may retrieve the cubic volume information from storage 110. In other embodiments, the procedure 500 may derive the cubic volume for each pill from other attributes stored as part of pill data 115.

Specifically with respect to the block 506, the procedure 500 may apply a number of known algorithms to the cubic volume information of a set of pills. For example, the procedure 500 may store each cubic volume value, along with a pill type identifier, as an element in a linked list. The procedure 500 may then re-arrange the linked list as a binary tree, for example, to efficiently arrive at an ordered list. The ordered list may have an ascending or descending order. As discussed above with respect to FIGS. 7-10, the pills may be placed into an intermediate filling unit or other type of intermediate storage location prior to being distributed to the corresponding cells of one or more multi-dose blister packs. Thus, it is contemplated that the embodiments that include an intermediate filling unit loaded and unloaded according to the first-in-first-out principle or, alternatively, that do not utilize any type of intermediate storage at all, may benefit from a list sorted in the descending order of cubic volume. Meanwhile, the procedure 500 generating a fill order for an embodiment using a first-in-last-out type of an intermediate filling unit may sort the pills in the ascending order of cubic volume.

Next, the procedure may begin stepping through the sorted list and iteratively depositing the pills into the appropriate containers (block 510). In some contemplated embodiments, the computer 102 may execute the blocks 502-508 of the procedure 500 and communicate the generated list to a human operator or to the filling entity 150, which may be fully automated, partially automated, or manually operated. In another possible embodiment, the computer 102 may execute the blocks 502-508, remotely control the filling entity 150 which may execute the blocks 510-514, and return to the block 504 for another one or more iterations through the blocks 504-508. It will be appreciated that the computer 102 may execute only part of the procedure 500 to produce one or more lists corresponding to efficient orders of fill. The procedure 500 may then communicate the one or more generated lists to the operator or to another entity.

The filling entity 150 may place the pills directly into the containers or into an intermediate filling unit according to the list obtained in the block 506. More specifically, the filling entity 150 may retrieve an individual pill in the order specified by the sorted list (block 510). Next, the procedure 500 may check whether all pills have been distributed (block 512) and, if the list is not empty, place the individual pill into the appropriate cell of the appropriate card. In particular, the procedure 500 may refer to the fill pattern specifying the mapping of the pills to the cells of one or more blister packs. In some embodiments, the filling entity 150 may deposit pills in parallel into several blister packs associated with several patients. In other words, the filling entity 150 may not always complete filling a certain blister pack prior to switching to another blister pack. If a certain pill is associated with several prescriptions, for example, the filling entity 150 may place the pill into each corresponding blister pack prior to handling another type or size of a pill.

Finally, the procedure 500 may return to the block 510 for the next iteration through the sorted list. If, however, the procedure 500 determines in the block 512 that all pills have been distributed, the control may return to the block 504, where the procedure 500 may transition to the next time of day associated with the prescription or, in other embodiments, to the next prescription associated with the time of day, for example. For example, the procedure 500 may transition to daytime medications after completing the ordering and/or distribution of pills associated with the morning or breakfast time.

It will be noted that while FIG. 11 illustrates an approach based on pill volume, the procedure 500 may similarly sort and distribute pills in view of one or several other attributes. For example, the procedure 500 may sort the pills according to weight and compatibility by using one of these two attributes as a primary sorting criterion and the other one of the two attributes as a tie-breaking criterion. Alternatively, the procedure 500 may derive a single value from each tuple having two or more attributes and sort the set of pills according to this single derived value.

Although the forgoing text sets forth a detailed description of numerous different embodiments, it should be understood that the scope of the patent is defined by the words of the claims set forth at the end of this patent. The detailed description is to be construed as exemplary only and does not describe every possible embodiment because describing every possible embodiment would be impractical, if not impossible. Numerous alternative embodiments could be implemented, using either current technology or technology developed after the filing date of this patent, which would still fall within the scope of the claims.

Thus, many modifications and variations may be made in the techniques and structures described and illustrated herein without departing from the spirit and scope of the present claims. Accordingly, it should be understood that the methods and apparatus described herein are illustrative only and are not limiting upon the scope of the claims.

What is claimed is:

1. A method in a computer system having a memory and a processor for efficiently packaging pills, the method comprising:

obtaining, by the processor from the memory, a volume of an individual container into which a first pill and a second pill are to be packaged, wherein the second pill differs from the first pill in at least one of size or composition and the individual container is included in a plurality of individual containers of a multi-dose medicament container;

obtaining, by the processor from the memory, a size of the first pill;

obtaining, by the processor from the memory, a size of the second pill;

determining, by the processor, a fill order of the individual container of the multi-dose medicament container based on the size of the first pill, the size of the second pill, and the volume of the individual container; and causing the first pill and the second pill to be placed into the individual container based on the determined fill order.

2. The method of claim 1, wherein obtaining the size of the first pill includes obtaining a volume of the first pill, comprising:

associating the volume of the first pill with a volume of a cuboid circumscribing the first pill; and calculating the volume of the cuboid based on pill dimensions stored in the memory and corresponding to the first pill.

3. The method of claim 1, wherein obtaining the size of the first and second pills includes receiving the size of the first and second pills from a database storing pill information.

4. The method of claim 1, wherein at least one of the first pill and the second pill includes medication.

5. The method of claim 1, wherein at least one of the first pill and the second pill is associated with a prescription.

6. The method of claim 1, further comprising:

obtaining a size of a third pill;

determining the fill order of the individual container of the multi-dose medicament container further based on the size of the third pill; and causing the third pill to be placed into the individual container based on the determined fill order.

7. The method of claim 6, wherein the multi-dose medicament container is a multi-dose blister pack, and wherein the plurality of individual containers are individually sealed cells of the multi-dose blister pack.

8. The method of claim 6, wherein:

the individual container is a first individual container included in the plurality of individual containers and the first individual container corresponds to a first time of ingestion prescribed to a patient;

a second individual container is included in the plurality of individual containers and corresponds to a second time of ingestion prescribed to the patient; and the method further comprises receiving a fill pattern specifying a mapping of the first, second, and third pills to the first and second individual containers.

9. The method of claim 1, wherein causing the first pill to be placed into the individual container based on the determined fill order includes:

placing the first pill and the second pill into an intermediate filling unit; based on the determined fill order, and retrieving the first pill and the second pill from the intermediate filling unit.

10. The method of claim 1, wherein determining the fill order of the individual container of the multi-dose medicament container comprises determining a first fill order of a first individual container of the multi-dose medicament container and determining a second fill order of a second individual container of the multi-dose medicament container, the first fill order being different from the second fill order.

11. The method of claim 1, wherein obtaining the volume of the individual container of the multi-dose medicament container comprises obtaining a first volume of a first individual container of the multi-dose medicament container and obtaining a second volume of a second individual container of the multi-dose medicament container, the first volume being different from the second volume.

12. The method of claim 1, wherein obtaining the volume of the individual container of the multi-dose medicament container comprises obtaining a first volume and a first shape of a first individual container of the multi-dose medicament container and obtaining a second volume and a second shape of a second individual container of the multi-dose medicament container, the first volume being equivalent to the second volume, and the first shape being different than the second shape.

13. The method of claim 1, wherein the size of the first pill is a first attribute of the first pill, and the size of the second pill is a first attribute of the second pill, and wherein determining the fill order of the individual container of the multi-dose medicament container is further based on at least a second attribute of the first pill and the at least a second attribute of the second pill.

14. The method of claim 13, wherein determining the fill order further based on the at least the second attribute comprises determining the fill order further based on at least one of: a pill weight, a pill shape, a pill color, a pill compatibility, a pill chemical weight, a pill chemical composition, a pill manufacturer information, a pill form or a pill dimension.

15. The method of claim 1, wherein obtaining the volume of the individual container of the multi-dose medicament container comprises obtaining a volume of each individual container included in the plurality of individual containers of the multi-dose medicament container.

* * * * *